US012453383B2

(12) United States Patent
Rockstroh

(10) Patent No.: US 12,453,383 B2
(45) Date of Patent: Oct. 28, 2025

(54) LEG GARMENTS AND RELATED METHODS

(71) Applicant: MEDI GMBH & CO. KG, Bayreuth (DE)

(72) Inventor: Martin Rockstroh, Creußen (DE)

(73) Assignee: MEDI GMBH & CO. KG, Bayreuth (DE)

( * ) Notice: Subject to any disclaimer, the term of this patent is extended or adjusted under 35 U.S.C. 154(b) by 0 days.

(21) Appl. No.: 17/399,961

(22) Filed: Aug. 11, 2021

(65) Prior Publication Data

US 2022/0046998 A1 Feb. 17, 2022

(30) Foreign Application Priority Data

Aug. 11, 2020 (EP) ..... 20020363

(51) Int. Cl.
*A41B 11/01* (2006.01)
*D04B 1/10* (2006.01)
(Continued)

(52) U.S. Cl.
CPC ..... *A41B 11/01* (2013.01); *D04B 1/108* (2013.01); *D04B 1/18* (2013.01); *D04B 1/243* (2013.01);
(Continued)

(58) Field of Classification Search
CPC ..... A41B 11/01; A41B 2500/10; A61F 13/08; D04B 1/108; D04B 1/26; D04B 1/265;
(Continued)

(56) References Cited

U.S. PATENT DOCUMENTS 335,704 A * 2/1886 Hoult ..... A41B 11/01 2/239
1,434,941 A * 11/1922 Boyd ..... A41B 11/005 66/172 R
(Continued)

FOREIGN PATENT DOCUMENTS

CA 784903 A 5/1968
CA 3064498 A1 * 11/2018 ..... A61F 13/08
(Continued)

OTHER PUBLICATIONS

Screen captures from YouTube video clip entitled "DIY Socks #2 (side seam method)," 11 pages, uploaded on Jan. 28, 2014 by user "Annika Victoria". Retrieved from Internet: <https://www.youtube.com/watch?v=bC1RcPBQmRM>. (Year: 2014).*
(Continued)

*Primary Examiner* — Aiying Zhao
(74) *Attorney, Agent, or Firm* — Rimon PC

(57) ABSTRACT

A leg garment, comprising a flat-knitted basic knitted fabric part forming at least one foot part, with at least one first functional zone which is knitted into the basic knitted fabric part and which is formed to accommodate a heel of a foot, wherein the flat-knitted basic knitted fabric part is sewn together by means of a longitudinal seam to form a tubular knitted fabric, wherein at least one first functional zone is knitted into the basic knitted fabric part in such a manner that in the worn state of the leg garment, the longitudinal seam connecting the basic knitted fabric part is arranged outside the sole of the foot at least in a heel area.

13 Claims, 4 Drawing Sheets

(51) Int. Cl.
*D04B 1/18* (2006.01)
*D04B 1/24* (2006.01)
*D04B 1/26* (2006.01)

(52) U.S. Cl.
CPC ..... *D04B 1/26* (2013.01); *D04B 1/265* (2013.01); *A41B 2500/10* (2013.01)

(58) Field of Classification Search
CPC ..... D10B 2501/021; D10B 2501/043; D10B 2509/028
See application file for complete search history.

(56) References Cited

U.S. PATENT DOCUMENTS

| | | | | | |
|---|---|---|---|---|---|
| 2,672,139 | A * | 3/1954 | Caspar | A61F 13/08 | 602/76 |
| 2012/0078156 | A1* | 3/2012 | Platz | A61F 13/08 | 602/76 |
| 2014/0058311 | A1* | 2/2014 | Higgins | A61F 13/06 | 602/63 |
| 2016/0242471 | A1* | 8/2016 | Marville | A41B 11/01 | |
| 2018/0353345 | A1 | 12/2018 | Sasaki | | |

FOREIGN PATENT DOCUMENTS

| | | | | | |
|---|---|---|---|---|---|
| DE | 588844 | C | * | 11/1933 | D04B 1/26 |
| DE | 1772612 | U | | 8/1958 | |
| DE | 102018004065 | A1 | | 11/2019 | |
| GB | 2316418 | A | * | 2/1998 | D04B 1/108 |
| JP | 11350203 | A | * | 12/1999 | |
| JP | H11350203 | A | | 12/1999 | |

OTHER PUBLICATIONS

Jennifer Donze. Top-Down Argyle Socks. Nov. 2012. Retrieved from Internet: <https://www.ravelry.com/patterns/library/top-down-argyle-socks> (Year: 2012).*

Jennifer Donze. Toe-Up Argyle Socks. 2012. Retrieved from Internet: https://web.archive.org/web/20130320130647/https://www.ravelry.com/patterns/library/toe-up-argyle-socks (Year: 2012).*

* cited by examiner

LEG GARMENTS AND RELATED METHODS

CROSS-REFERENCE TO RELATED APPLICATIONS

This application claims priority to European patent application serial number 20020363.6, filed Aug. 11, 2020, the contents of each of which is incorporated herein by reference in its entirety.

FIELD OF THE INVENTION

The present invention relates to leg garments and related methods.

BACKGROUND

Such leg garments are formed in particular in the form of footlets, socks, stockings, in particular as calf or thigh stockings, or, for example, as pantyhose. For medical use and/or for use during sporting activities, they often have one or more compressive areas, which serve to exert targeted pressure on the body of a patient. The pressure exerted on a patient's body is referred to as compression. The aim of compressive leg garments, for example, in particular for medical use, is, among other things, to relieve a patient's damaged venous and/or lymphatic system. The pressure applied prevents increasing swelling of the limbs, improves the return flow of venous blood and lymph, and increases the blood supply. When compressive leg garments are used in the field of sports, it causes an increase in performance or improved regeneration.

For the formation of these preferably compressive leg garments, they are circular-knitted using a circular knitting machine or flat-knitted using a flat knitting machine and then sewn together by means of a longitudinal seam to form a tubular knitted fabric. The basic knitted fabric is knitted from at least one stitch-forming basic knitting thread over several stitch courses. To form compressive knitted fabric parts, an elastic weft thread is preferably inserted into the knitted stitches in every, or in every X-th, preferably in every second course. RAL-GZ 387 of the Quality Mark Association relates to the manufacture, in particular to the measurement and quality assurance, of compression arm or leg sleeves for medical use. The test specifications of the RAL describe how the pressure of a compression stocking on a leg is to be determined. As a means of measurement, in particular with a compression testing device, testing on the HOSY measuring device (Institut Hohenstein) is suggested. The test is carried out, among other things, by measuring the tension force in the several measuring points, which varies depending on the respective elasticity of the knitted fabric. The compression is calculated from the tension force in combination with other parameters affecting the knitted fabric. This means, the greater the elasticity of a knitted fabric in the transverse direction of the knitted fabric, the lower the compression exerted by the knitted fabric on the patient. On the other hand, the lower the elasticity of the knitted part, the higher the compression exerted on the patient.

Known from the prior art is a large number of preferably flat-knitted leg garments, in particular in the form of leg stockings, which are sewn together by means of a longitudinal seam to form a tubular knitted fabric.

Such a leg garment, in particular in the form of a compressive stocking, is disclosed in DE 1 772 612 U, for example.

This known stocking, also referred to as a rubber-elastic bandage, is characterized by a special seam which, in the worn state, is no longer bulging, thus, it is extremely flat and thus does not form a bulging bead. For this purpose, the edges are butted together and sewn together using a special flat seam machine. Previously, the connecting seams were sewn together by overlapping the edges, which resulted in a wide bead at the joint. The resulting increased compression causes pain for the wearer of the stocking in the area of the seam. Furthermore, the stocking is formed in this case in such a manner that the seam of the stocking runs along the rear side thereof, in particular centrally on the rear side.

This known arrangement of the seam in a flat-knitted, in particular compressive, leg garment is also known, for example, from CA 784903 A.

CA 784903 A also discloses a compressive leg stocking, in particular in the form of a thigh stocking. This stocking, in particular the knitted fabric according to the invention disclosed therein, is selectively produced by means of a circular knitting machine or a flat knitting machine. When the stocking is formed as a circular-knitted fabric, the stocking is preferably knitted without a seam. When the stocking is produced by a flat-knitted fabric, it is sewn together by means of a longitudinal seam to form a tubular knitted fabric, in particular a stocking. Here, too, the flat-knitted fabric is formed in such a manner that the seam of the stocking runs along the rear side thereof, in particular centrally on the rear side. Specifically, the seam begins at the lower end of the stocking, namely the underside of the toe portion of the stocking, runs centrally along the sole of the foot and centrally through a heel portion of the stocking. Subsequently, the seam is arranged centered at the rear side of the stocking, namely in a calf area and the hollow of the knee, and extends to an upper end of the stocking, which is formed by an adhesive band.

The poor wearing comfort of this arrangement of the longitudinal seam, which is known from the prior art and is generally used for a preferably compressive and flat-knitted leg garment, has proven to be a disadvantage.

The formation of the flat-knitted fabric in such a manner that in a worn state, the seam is located in the area of the sole of the foot, in particular in a heel area, results in the fact that the wearer of the sock steps on the seam every time he comes into contact with the ground. In this case, the entire body weight of the wearer exerts pressure on the seam, which leads to pain for the wearer in the area of the seam, in particular if, for example, an additional seam tape, which is sewn onto the two knitted edges of the flat-knitted fabric, is used to improve the seam durability. The arrangement of the seam in the calf area and the increased compression there, in particular caused by the activity of the calf muscle pump, can also lead to pain in the area of the seam. Finally, the formation of wrinkles in the area of the hollow of the knee, caused by the seam, also results in reduced wearing comfort when the stocking is formed as a thigh stocking.

A further disadvantage of the leg garments known from the prior art is that the stockings are unsuitable for diabetics or allergy sufferers, in particular persons with sensitive feet. As previously mentioned, in some places there is increased pressure on the sole of the foot due to the arrangement of the seam in the area of the sole of the foot. In patients with no pain sensation and chronic wounds in the area of the foot, in particular in the area of the sole of the foot, this can result in further irritation of the wound. Due to poor wound healing in patients suffering from diabetes, this should be avoided at all costs.

Finally, it also proves disadvantageous that the arrangement of the seam in zones of increased load, namely the sole of the foot, the heel, in the area of the calf muscle pump or in the area of the hollow of the knee, greatly impairs the durability of the stocking. In the above-mentioned zones, even under normal load, there are increased pressure loads, frictional forces, as well as tensile forces on the seam caused by the stretching of the knitted fabric, in particular caused by the movement of two body parts connected to each other via a joint, e.g. the ankle joint.

It is therefore an object of the present invention to create a leg garment which avoids the disadvantages of the prior art and, in particular, significantly improves the wearing comfort of a flat-knitted, preferably compressive leg garment which is closed by means of a longitudinal seam.

According to an exemplary embodiment, the leg garment has at least one flat-knitted basic knitted fabric part forming a foot part with at least one first functional zone which is knitted into the basic knitted fabric part and which is formed to accommodate a heel of a foot, wherein the flat-knitted basic knitted fabric part is sewn together by means of a longitudinal seam to form a tubular knitted fabric and wherein the at least one first functional zone is knitted into the basic knitted fabric part in such a manner that in the worn state of the leg garment, the longitudinal seam connecting the basic knitted fabric part is arranged outside the sole of the foot at least in a heel area.

According to a second exemplary embodiment, the longitudinal seam of the basic knitted fabric part preferably extends at least partially medially or laterally on the side of the foot and/or extends over the upper side of the foot in the worn state of the leg garment. Particularly preferably, in the worn state of the leg garment, the longitudinal seam preferably extends over the entire foot length medially or laterally on the side of the foot and/or extends over the upper side of the foot. As a result, the sole of the foot is free of any seams, which leads to a significantly improved wearing comfort.

According to a third exemplary embodiment of the leg garment, the flat-knitted basic knitted fabric part additionally forms a toe part, the toe part being sewn together by means of a transverse seam to form a closed foot tip. When the foot part is formed in such a manner that in the worn state of the leg garment, the longitudinal seam of the foot part runs medially or laterally on the side of the foot, the longitudinal seam of the foot part and the transverse seam of the toe part are preferably formed as one continuous seam. Hereby, the entire leg garment, in particular the flat-knitted basic knitted fabric part, can be closed by one manufacturing step, namely a single seam. A second seam is not necessary.

According to a fourth exemplary embodiment of the leg garment, the flat-knitted basic knitted fabric part additionally forms a lower leg part, wherein in the worn state of the leg garment, the longitudinal seam extends medially or laterally on the side of the lower leg and/or extends over the front side, in particular along the shinbone. Preferably, the seam extends on that side, thus medially, laterally or on the front side of the leg, in the same way as it extends in the adjoining foot part. This means, if the seam in the foot part extends, e.g., medially on the inside of the foot, then the seam in the lower leg part preferably also extends medially, thus on the inside of the leg. The same applies to the lateral placement or arrangement at the seam on the upper side of the foot. Alternatively, it is of course also possible for the leg garment to be formed in such a manner that in the worn state of the leg garment, the arrangement of the seam differs between the foot part and the lower leg part. All combinations are conceivable, particularly preferred, for example: seam in the foot part arranged medially and in the lower leg part arranged on the front side, seam in the foot part arranged laterally and in the lower leg part arranged on the front side, seam in the foot part arranged at the upper side of the foot and in the lower leg part arranged medially, seam in the foot part arranged at the upper side of the foot and in the lower leg part arranged laterally. The listing is not exhaustive.

According to a fifth exemplary embodiment of the leg garment, the flat-knitted basic knitted fabric part forms a thigh part in addition to the lower leg part, wherein in the worn state of the leg garment, the longitudinal seam extends medially or laterally on the side of the thigh and/or extends over the front side of the thigh. Here, too, the seam preferably extends on that side, thus medially, laterally or on the front side of the leg, in the manner in which it also extends in the adjoining lower leg part and foot part. However, here too, the extent of the seam can differ between foot part, lower leg part and/or thigh part. For example, the seam in the foot part extends at the upper side of the foot to keep an ankle area free of a seam and then extends medially or laterally in the area of the lower leg and thigh so that a knee area and a hollow of the knee are also free of a seam. However, it is also conceivable that in the worn state of the leg garment, the longitudinal seam extends on different sides in all three areas, thus in the foot part, lower leg part and thigh part, in order to obtain maximum wearing comfort.

According to a sixth exemplary embodiment of the leg garment, the flat-knitted basic knitted part forms an abdominal part in addition to the thigh part, wherein in the worn state of the leg garment, the longitudinal seam extends on the side of the pelvis and/or over the front of the pelvis. Here, too, the extent of the longitudinal seam in the foot part, lower leg part, thigh part and/or abdominal part can be effected in the same manner, thus, for example, continuously medially on the side of the leg, or can differ.

According to a further exemplary embodiment, the flat-knitted basic knitted part has at least one second functional zone knitted into the basic knitted fabric part. The second functional zone preferably has a higher elasticity in the longitudinal and/or transverse direction compared to areas of the flat-knitted basic knitted part outside of the second functional zone. The second functional zone can serve, for example, as a relief zone in the ankle area or in the instep area, in particular to prevent the formation of wrinkles there.

According to a further exemplary embodiment, the knitted fabric edges of the flat-knitted basic knitted fabric part, which extend between a knitted fabric beginning and a knitted fabric end and are opposite one another, are formed symmetrically, in particular mirror-symmetrically, with respect to one another. Particularly preferably, the opposite knitted fabric edges of the flat-knitted basic knitted fabric part running between a knitted fabric beginning and a knitted fabric end are formed asymmetrically with respect to one another. This enables the longitudinal seam to be guided along the leg of a wearer, in particular past sensitive points on the leg of a wearer, such as, for example, the ankle, the hollow of the knee, or past other local sensitive points, such as wounds. Particularly preferably, the course of the knitted fabric edges and thus the course of the longitudinal seam along the foot part, the lower leg part, the thigh part and/or the abdominal part is determined individually, thus, depending on the person. In particular in the case of a customized solution, in which the patient receives a customized leg garment and the basic knitted fabric part is thus knitted to measure, it is thus possible to individually determine and fix the position of the longitudinal seam on the leg of a wearer.

According to another exemplary embodiment, the flat-knitted basic knitted fabric part is formed by one or more stitch-forming basic knitting threads and at least one inserted weft thread. Particularly preferably, it has a gradual compression curve in the longitudinal direction of the knitted fabric. The gradual compression curve is preferably determined by the manner, in particular by the number of successive stitch courses in which the weft thread is placed. The compression strength preferably decreases or increases continuously in the longitudinal direction of the knitted fabric. The compressive pressures generated by the flat-knitted basic knitted fabric part are here preferably between 10 and 60 mmHg in an ankle area of the leg garment and between 5 and 50 mmHg in a calf area.

According to a further embodiment, the leg garment is formed in one piece or in multiple pieces. That is, the multiple parts, namely the foot part, the lower leg part, the thigh part and/or the abdominal part are formed by a single continuous flat-knitted basic knitted fabric part, or by two or more basic knitted fabric parts formed separately from one another, each of which is sewn together by a longitudinal seam to form a tubular knitted fabric. The multi-part formation makes it easier to put on.

The leg garment according to the previous exemplary embodiments is preferably formed as a footlet, sock, stocking, in particular as a calf or thigh stocking, as pantyhose, foot bandage, or as a knitted part of a foot orthosis. Particularly preferably, it is formed as a compressive leg garment, wherein the compression strength increases or decreases in the longitudinal direction of the knitted fabric, in particular from the ankle towards the upper end of the knitted fabric.

The present leg garment is characterized by a number of significant advantages.

By forming the leg garment in such a manner that in the worn state of the leg garment, the longitudinal seam connecting the basic knitted fabric part of the leg garment is arranged outside the sole of the foot, at least in a heel area, a significantly improved wearing comfort is achieved. No disturbing seam connection, which can lead to pain in the area of the seam for the wearer, is arranged between the foot of the wearer and a tread surface. The foot sole of the leg garment is thus preferably free of any seam connections. The seam thus preferably consists only of the uniformly knitted basic knitted fabric part. In any case, no irritation-inducing elements of the basic knitted fabric part are contained in the foot sole of the leg garment.

Furthermore, when the leg garment is formed, for example, as a calf or thigh stocking, the arrangement of the longitudinal seam medially or laterally on the side of the lower leg or on the front side, thus, in the area of the shinbone, is such that in the worn state of the leg garment, the seam is not arranged in the calf area of the leg of a wearer. Thus, the rear calf area is also free of any seam connections. The activity of the calf muscle pump therefore does not lead to pain in the area of the lower leg caused by disturbing or irritant elements in the calf area of the basic knitted fabric part.

Finally, the arrangement of the longitudinal seam medially or laterally on the side or front of the lower leg and thigh in the worn state of the leg garment brings the advantage that no disturbing seam connection is arranged in the area of the hollow of the knee. This also leads to a significantly improved wearing comfort due to the reduced formation of wrinkles.

A further advantage of the invention is that the leg garment according to the invention is also particularly suitable for sensitive feet, thus, in particular for diabetics or allergy sufferers. Due to the fact that the sole of the foot is preferably free of any seams, there is no irritation of the sole of the foot, in particular of wounds in the area of the sole of the foot in patients without pain sensation and chronic wounds in the area of the foot.

It is also particularly advantageous that as a result of the leg garment according to the invention, the longitudinal seam of the basic knitted fabric part is arranged outside of those areas of the leg garment which, as a result of use, are subject to increased load, in particular the sole of the foot and the heel. This ultimately results in the durability of the leg garment being significantly improved.

BRIEF DESCRIPTION OF THE DRAWINGS

In the following, the invention is explained by means of several exemplary embodiments and in connection with the attached drawings.

In the figures.

DETAILED DESCRIPTION

Figure 1:
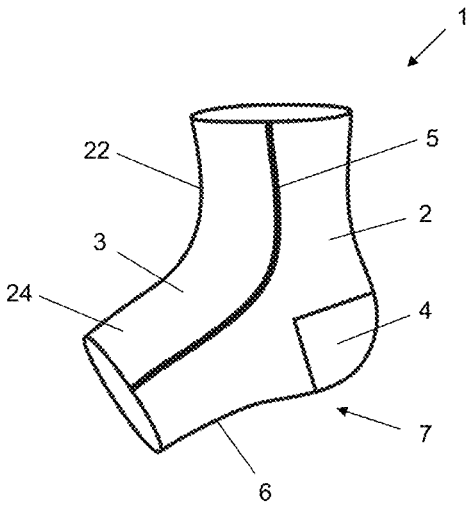
FIG. 1 shows a first exemplary embodiment of the leg garment according to the invention, which has a flat-knitted basic knitted fabric part and is formed as a sock with an open tip.

FIG. 1 shows a first exemplary embodiment of the leg garment 1 in the form of a preferably compressive and preferably medical sock with an open tip. The leg garment 1 comprises a foot part 2, which is made from a basic knitted fabric part 3 which is flat-knitted over a plurality of stitch courses and which in turn is sewn together by means of a longitudinal seam 5 to form a tubular knitted fabric. A first functional zone 4 formed to accommodate a heel of a foot is knitted into the basic knitted fabric part 3. Here, the first functional zone 4 is knitted into the basic knitted fabric part 3 in such a manner that in the worn state of the leg garment 1, the longitudinal seam 5 connecting the basic knitted fabric part is arranged outside the sole of the foot 6, at least in a heel area. In the exemplary embodiment shown, the seam 5 runs medially on the inner side 7 of the foot of a wearer of the leg garment 1, thus on the inner side in the midfoot area 24, the heel area as well as the ankle area 22. The sole of the foot 6 thus does not have a seam connection which is disturbing for the wearer of the leg garment 1.

According to this and the following exemplary embodiments, the basic knitted fabric part 3 itself is formed as a single-layer or multi-layer flat-knitted fabric. Preferably, the basic knitted fabric part 3 is formed by a right-right weave consisting of an RR knitting thread (right-right knitting thread) and an inserted weft thread, or by a half tubular weave consisting of an RR knitting thread, an RL knitting thread (right-left knitting thread) and the inserted weft thread.

According to this and the following exemplary embodiments, the longitudinal seam 5, in turn, preferably has a seam tape for improved seam durability or seam strength. This is a tape-shaped textile element which is sewn together with the two knitted fabric edges of the flat-knitted fabric. Alternatively, the longitudinal seam 5 can also be formed simply as an overlapping or butt-to-butt joint.

According to a preferred exemplary embodiment, the leg garment 1 is a compressive sock whose generated compressive pressures in an ankle area 22 are preferably between 10 and 60 mmHg, and in a midfoot area 24 are preferably between 10 and 50 mmHg. The basic knitted fabric 3 flat-knitted on a flat knitting machine has one or more weft threads inserted in a plurality of courses of basic knit stitches. The compressive values are measured by means of the measuring method and measuring device presented at the beginning, in particular by means of testing on the HOSY measuring device (Institut Hohenstein).

Figure 2:
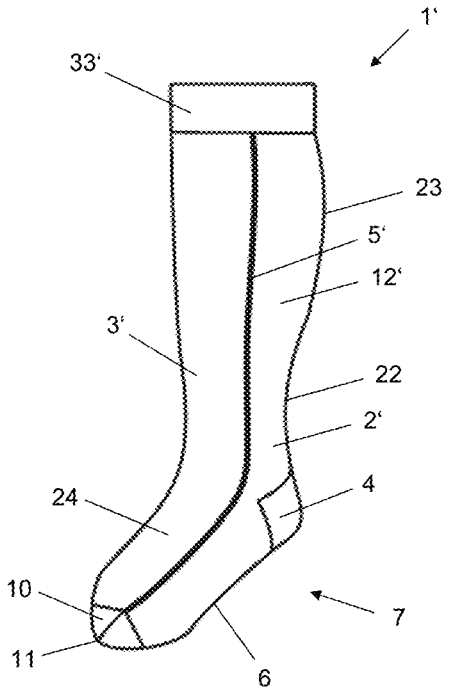
FIG. 2 shows a second exemplary embodiment of the leg garment according to the invention, which has a flat-knitted basic knitted fabric part and is formed as a stocking, in particular as a calf stocking.

FIG. 2 shows a second exemplary embodiment of the flat-knitted leg garment 1', which is formed as a stocking, in particular as a calf stocking. The stocking comprises a preferably compressive basic knitted fabric part 3' forming a foot part 2' and a lower leg part 12'. In addition, the leg garment 1', preferably the basic knitted fabric part 3', has a toe part 10, the toe part 10 being sewn together by means of a transverse seam 11 to form a closed foot tip. The foot tip formed in this manner can thus be sewn to the basic knitted fabric part 3' or knitted integrally therewith. At the opposite end of the stocking 1', an adhesive portion 33' in the form of a preferably two-layer waistband or an adhesive band is knitted or sewn to the basic knitted fabric part 3'. This serves to prevent the stocking from slipping on the wearer's leg.

According to this exemplary embodiment, the longitudinal seam 5' connecting the flat-knitted basic knitted fabric part 3' runs in the basic knitted fabric part 3' due to the special arrangement of the first functional zone 4, namely the heel, and due to the formation of the basic knitted fabric part 3' itself, runs in the midfoot area 24, the ankle area 22, as well as in the calf area 23 medially on the inner side 7 of the foot and leg of a wearer of the leg garment 1'. The side of the leg garment 1 facing the sole of the foot 6 of a wearer is thus free of an interfering seam connection. The calf area 23 also does not have an interfering seam connection.

Preferably, the calf stocking shown is formed as a compressive leg garment 1'. Here, the compressive pressures in the ankle area 22 are preferably between 10 and 60 mmHg, and in the calf area between 5 and 50 mmHg. The compressive strength preferably decreases here from the lower end in the direction of the calf muscles. Alternatively, an increasing pressure curve is also possible.

Figure 3:
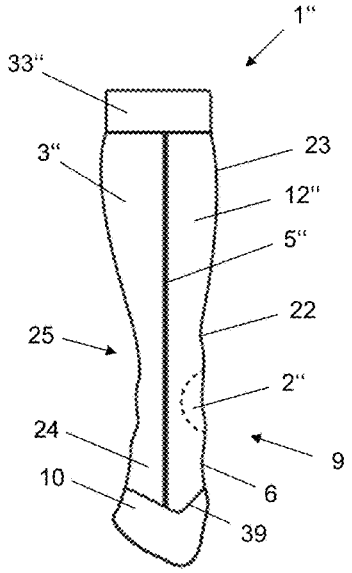
FIG. 3 shows a third exemplary embodiment of the leg garment according to the invention, which is also formed as a stocking, in particular as a calf stocking, as shown in FIG. 2.

FIG. 3 shows a third exemplary embodiment of leg garment 1", which is also formed as a stocking, in particular as a calf stocking, as shown in FIG. 2. The stocking 1" also includes a lower leg part 12" and a toe part 10 in addition to a foot part 2". According to this exemplary embodiment, the toe part 10 is preferably sewn to the basic knitted fabric part 3" by means of a seam connection 39. The adhesive portion 33" is also provided. However, the calf stocking differs here in particular in that the functional zone 4 of FIG. 2, namely the preferably knitted-in heel, is incorporated into the basic knitted fabric part 3" or into the foot part 2" in such a manner that in the worn state of the leg garment 1", the longitudinal seam 5" extends in a midfoot area 24 over the upper side of the foot 9 and in an ankle area 22 as well as a calf area 23 over the front side 25 of the leg garment 1", in particular along the shinbone of a wearer. The longitudinal seam 5" meets the seam connection 39 on the upper side of the foot 9. As a result it is possible that the seam 5" as well as the seam 39 can be formed as a single seam, in particular a continuous seam. The sole of the foot 6 is thus free of seams in a rear heel area, which results in significantly improved wearing comfort.

The toe part 10, in particular the formed foot tip, can also have other shapes in addition to the closed variant shown, for example an open tip or a plurality of tubular knitted fabric parts, one for each individual toe. In this case, the open or closed foot tips preferably have different pressure profiles, which are selectively combined with the pressure profiles of the foot and lower leg parts 2", 12", preferably according to the several compression classes 1 to 4 according to RAL-GZ 387.

Figure 4:
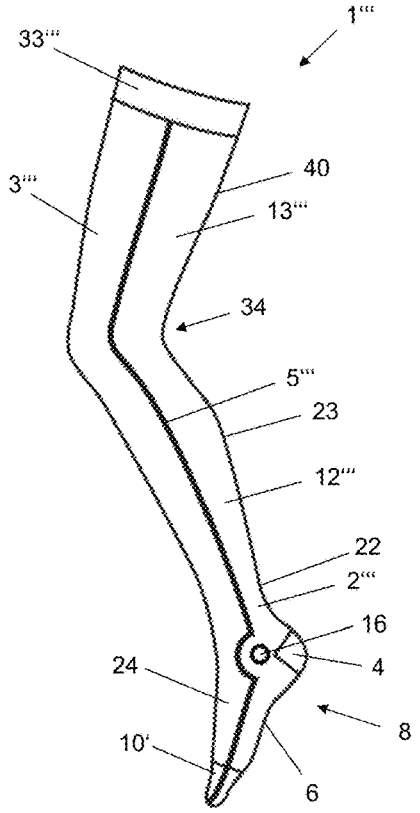
FIG. 4 shows a fourth exemplary embodiment of the leg garment according to the invention, which is formed as a thigh stocking.

FIG. 4 shows a leg garment 1''', which is formed as a thigh stocking. The thigh stocking 1''' consists of a foot part 2''', a lower leg part 12''' and a thigh part 13''', which are made from a basic knitted fabric part 3''', preferably a single basic knitted fabric part 3''', flat-knitted over a plurality of stitch courses. Moreover, the foot part 2''' has a preferably knitted-on toe part 10'. In this exemplary embodiment, an adhesive band 33''' is knitted on the upper end of the thigh stocking 1''' so that a secure hold of the leg garment 1''', in particular on the thigh, is ensured.

According to this exemplary embodiment, the longitudinal seam 5''' connecting the flat-knitted basic knitted fabric part 3''' extends in the basic knitted fabric part 3''' due to the specific arrangement of the first functional zone 4, and, due to the formation of the basic knitted fabric part 3''' itself, extends in the midfoot region 24, the ankle region 22, the calf region 23, as well as the thigh region 40 laterally on the outer side 8 of the foot and leg of a wearer of the leg garment 1'''. Moreover, the seam 5''' extends into the toe part 10' and closes the tip of the preferably knitted-on foot tip. The flat-knitted basic knitted fabric part 3''' is thus sewn together by a single and, in particular, continuous seam connection to form a closed tubular knitted fabric, which results in significant time and thus cost savings. Multiple seam connections to be made manually are no longer necessary. In addition to the significantly improved wearing comfort, in particular due to the fact that the sole of the foot 6 as well as the hollow of the knee 34 are free of a disturbing seam connection due to the lateral arrangement of the seam 5''', the exemplary embodiment shown thus implies the advantage of a time- and cost-saving manufacturing option.

Particularly preferably, according to this exemplary embodiment, the basic knitted fabric part 3''' is formed in such a manner that the seam 5''' running along the side of the thigh stocking 1''' runs in particular around a sensitive ankle zone 16 of a wearer of the leg garment 1''', that is, does not cross it. This is done in that the knitted fabric edges of the flat-knitted basic knitted fabric part 3''' situated opposite each other and extending between a knitted fabric beginning and a knitted fabric end are asymmetrical to one another, which will be explained in more detail later in FIG. 7.

Figure 5:
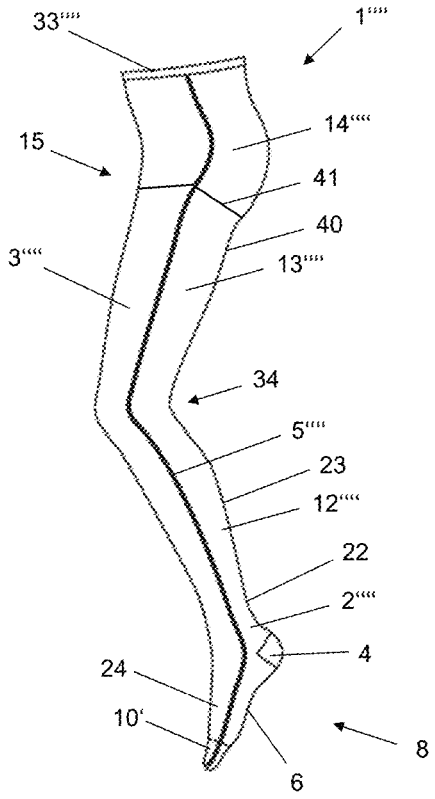
FIG. 5 shows a fifth exemplary embodiment of the leg garment according to the invention, which is formed as a pantyhose.

Finally, FIG. 5 shows a leg garment 1'''' in the form of a pantyhose with an upper waistband 33''''. The pantyhose 1'''' consist of a flat-knitted basic knitted fabric part 3'''', which has a foot part 2'''', which in turn has a first functional zone 4' in the form of a heel and a toe part 10', a lower leg part 12'''', a thigh part 13'''' and an abdominal part 14''''. The flat-knitted basic knitted fabric part 3'''' is sewn together by means of a longitudinal seam 5'''' to form a tubular knitted fabric. The longitudinal seam 5''' connecting the flat-knitted basic fabric part 3''' runs in a midfoot area 24, an ankle area 22, a calf area 23 and a thigh area 40 laterally on the outer side 8 of the foot and the leg of a wearer of the leg garment 1''''. Also, in the abdominal part 14'', which is preferably sewn to the thigh part 13'''' by means of a transverse seam 41, the seam 5'''' is arranged on the outer side 15 of the pelvis. Thus, neither in the area of the sole of the foot 6, the hollow of the knee 34 nor in a buttock area does the preferably compressive and flat-knitted leg garment 1'''' have a seam connection which is disturbing for the wearer of the leg garment 3'''' and worsens the wearing comfort.

Figure 6:
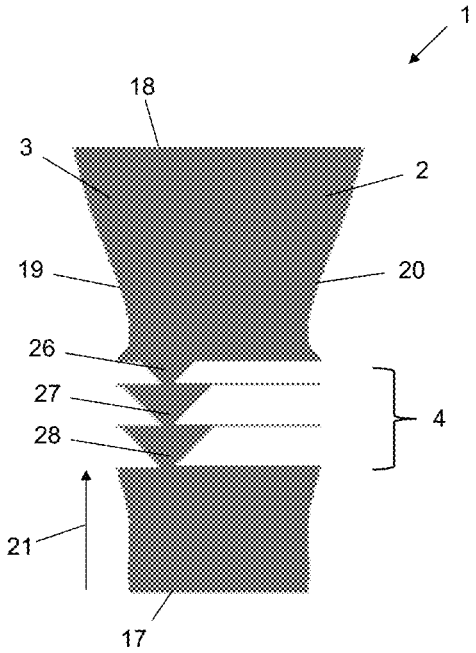
FIG. 6 shows a schematic illustration of the knitting sequence of the flat-knitted basic knitted fabric part as used to form the leg garment as shown in FIG. 1.

FIG. 6 now shows in a schematic illustration the knitting sequence of the flat-knitted basic knitted fabric part 3 as used to form the leg garment 1 shown in FIG. 1. The flat-knitted basic knitted fabric part 3, in particular the foot part 2, is formed by means of at least one basic knitting thread, preferably by means of a plurality of basic knitting threads which is/are knitted in a stitch-forming manner over a plurality of knitting rows from left to right and/or from right to left in the longitudinal direction 21 of the knitted fabric. The basic knitted fabric part 3 knitted on a flat knitting machine thus forms a flat-knitted fabric which has a lower knitted fabric beginning 17, an upper knitted fabric end 18 and knitted fabric edges 19 and 20 on the left and right respectively. Preferably, at least one elastic weft thread is inserted into the basic knitted fabric part 3, preferably in each or every n-th stitch course, in order to provide the basic knitted fabric part 3 with compressive properties.

In order for the longitudinal seam connecting the basic knitted fabric part 3, in particular the knitted edges 19 and 20, to be now arranged at least in a heel region outside the sole of the foot when the leg garment 1 is worn, the first functional zone 4, which is formed to accommodate a heel of a foot, is arranged substantially, thus preferably over its entire width, between the knitted fabric edges 19 and 20. The functional zone 4, at least that area of the zone 4 which in the worn state is arranged in the lower heel area—that is, that area of the heel which is associated with the sole of the foot—is therefore not divided by the knitted fabric edges 19 or 20. This would have the consequence that the seam runs through the functional zone 4, in particular through the heel area which is associated with the sole of the foot, which is precisely what is to be avoided according to the invention.

According to the exemplary embodiment shown, the first functional zone 4 for accommodating the heel is now formed by a plurality of, preferably three, gussets 26, 27 and 28. A gusset is a substantially trapezoidal knitted fabric portion extending over multiple stitch courses. Here, the number of stitches formed decreases or increases stich course by stitch course. This results in partial stich courses of different lengths. This ultimately results in a corresponding geometrically defined portion, in particular due to the formation of several successive gussets.

As can be seen in FIG. 6, the gussets 26, 27 and 28 are arranged in their entirety, thus over their entire width, between the knitted fabric edges 19 and 20. That is, the multiple gussets are not divided by the knitted fabric edges 19 and 20. Thus, with respect to a stitch course in the area of the gussets, there is only one partial stitch course, thus no second partial course separated and spaced apart from the first one, within a same stitch course. Gusset beginning and gusset end are therefore situated between the knitted fabric edges 19 and 20. Depending on where the seam is to be positioned on the foot of the wearer in the worn state of the basic knitted fabric part 3, the gussets 26, 27 and 28 are knitted into the basic knitted fabric part 3 at different distances from the knitted fabric edges 19 and 20. In the example shown, the gussets 26, 27 and 28 are arranged much closer to the left knitted fabric edge 19, which, in the worn state, results in the seam of the leg garment 1 coming to lie on the side of the foot of a wearer. For example, if the gussets are knitted centrally into the basic knitted fabric part 3, the seam will come to lie on the upper side of the foot. However, the seam is in any case arranged outside the sole of the foot of a wearer.

Figure 7:
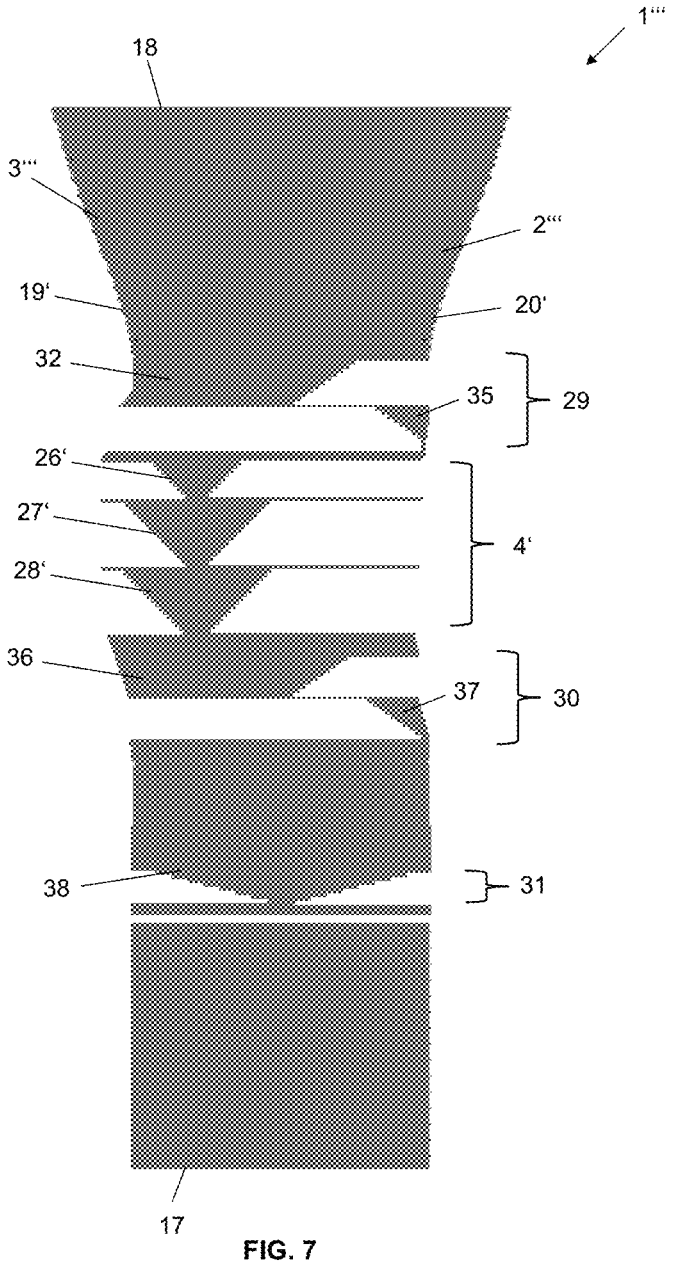
FIG. 7 shows a schematic illustration of the knitting sequence of the flat-knitted basic fabric part, in particular a detail thereof, as shown in FIG. 4.

FIG. 7 now shows a schematic illustration of the knitting process of the flat-knitted basic fabric part of the leg garment 1'', in particular a section thereof, namely the foot part 2''', as shown in FIG. 4. According to this exemplary embodiment, the flat-knitted basic knitted fabric part 3''' with the lower knitted fabric beginning 17, the upper knitted fabric end 18 as well as the left and right knitted fabric edges 19' and 20' has several incorporated functions 4', 29, 30, 31.

As explained in FIG. 7, the first functional zone 4' forms a heel and is also formed here by three gussets 26', 27', 28' that are incorporated into the basic knitted fabric part 3'''. In front of the first functional zone 4', a second functional zone 31 formed by a further gusset 38 is knitted into the basic knitted fabric part 3'''. This gusset 38 too is knitted into the basic knitted fabric part 3''' over the entire width of the gusset, preferably between the two knitted fabric edges 19' and 20'. This serves to form an angular forefoot area. The latter is formed by the gusset 38 arranged centrally in the knitted fabric and the gussets 26', 27' and 28' of the heel arranged offset thereto in the basic knitted fabric part 3'''. Furthermore, a third and fourth functional zone 29, 30 are knitted in immediately before and after the first functional zone 4'. These zones are also formed by gussets 32 and 35 as well as 36 and 37. These two zones serve to reduce the number of stitches in the midfoot area, in particular in the area of the instep, so that in the worn state, there is less to no formation of wrinkles caused by the basic knitted fabric part 3'''.

The invention is not limited to the exemplary embodiments described, but rather comprises all embodiments that apply or include the analogical basic functional principle of the invention. Furthermore, all features of all described and illustrated exemplary embodiments can be combined with each other.

The invention claimed is:

1. A compressive leg garment, comprising:

a flat-knitted basic fabric part knitted on a knitting machine forming at least one foot part comprising a longitudinal length and a transverse width, with at least one first functional zone formed to accommodate a heel of a foot that is knitted into the flat-knitted basic fabric part; and wherein the at least one first functional zone comprises a plurality of successive knitted gussets formed by successive partial stitch courses, wherein the flat-knitted basic fabric part is formed by a right-right weave, or by a half tubular weave, each of the right-right weave and the half tubular weave having an inserted weft thread, wherein each of the successive partial stitch courses is arranged between transverse edges of the flat-knitted basic fabric part and within the transverse width, wherein the flat-knitted basic fabric part is a single continuous flat-knitted basic fabric with two transverse edges sewn together by means of a single longitudinal seam to form a tubular knitted fabric to form the compressive leg garment with a foot shape having a heel area, wherein the at least one first functional zone is knitted into the flat-knitted basic fabric part in such a manner that in a worn state of the leg garment, the longitudinal seam connecting the flat-knitted basic fabric part is arranged outside of a heel area of the foot, wherein the single longitudinal seam comprises the only longitudinal seam positioned outside of the heel area, forming the compressive leg garment of a single piece of the flat knitted fabric part, wherein the heel area is free of irritation inducing elements of the basic knitted fabric part, and wherein the flat-knitted basic fabric part has a gradual compression curve in a longitudinal direction of the tubular knitted fabric of the leg garment such that the compressive leg garment exerts compression on a limb in its worn state, and wherein compressive pressures generated by the flat-knitted basic fabric part are between 10 and 60 mmHg in an ankle area of the leg garment and between 5 and 50 mmHg in a calf region.

2. The compressive leg garment according to claim 1, wherein in the worn state of the leg garment, the longitudinal seam extends medially or laterally on a side of the foot and/or extends over an upper side of the foot.

3. The compressive leg garment according to claim 1, wherein the flat-knitted basic fabric part additionally forms a toe part, wherein the toe part is sewn together by means of a transverse seam to form a closed toe cap.

4. The compressive leg garment according to claim 3, wherein the longitudinal seam of the foot part and the transverse seam of the toe part are formed as a continuous seam.

5. The compressive leg garment according to claim 1, wherein the flat-knitted basic fabric part additionally forms a lower leg part, and wherein in the worn state of the leg garment, the single longitudinal seam extends medially or laterally on a side of a lower leg and/or extends over a front side of the lower leg along a shinbone.

6. The compressive leg garment according to claim 5, wherein the flat-knitted basic knitted fabric part additionally forms a thigh part, wherein in the worn state of the leg garment, the single longitudinal seam extends medially or laterally on a side of a thigh or extends over a front side of the thigh.

7. The compressive leg garment according to claim 6, wherein the flat-knitted basic knitted fabric part additionally forms an abdominal part, wherein in the worn state of the leg garment, the single longitudinal seam extends on a side of a pelvis or extends over a front side of the pelvis.

8. The compressive leg garment according to claim 1, wherein the flat-knitted basic fabric part has at least one second functional zone which is knitted into the flat-knitted basic fabric part and which has a higher elasticity in a longitudinal and/or transverse direction compared to areas of the flat-knitted basic fabric part outside of the at least one second functional zone.

9. The compressive leg garment according to claim 1, wherein two knitted fabric edges of the flat-knitted basic knitted fabric part, which extend between a knitted fabric beginning and a knitted fabric end and are opposite one another, are formed symmetrically with respect to one another.

10. The compressive leg garment according to claim 1, wherein two knitted fabric edges of the flat-knitted basic fabric part, which extend between a knitted fabric beginning and a knitted fabric end and are situated opposite one another, are asymmetrical to one another.

11. The compressive leg garment according to claim 1, wherein the leg garment is formed in one piece or in multiple pieces.

12. The compressive leg garment according to claim 1, wherein the leg garment is a footlet, a sock, a stocking, a calf stocking, a pantyhose, a foot bandage, or a knitted part of a foot orthosis.

13. The compressive leg garment according to claim 1, wherein the plurality of the gussets are not divided by the two transverse edges of the flat-knitted basic fabric.

* * * * *